US012215552B2

(12) United States Patent
Ferreira Da Silva et al.

(10) Patent No.: US 12,215,552 B2
(45) Date of Patent: Feb. 4, 2025

(54) POLYVALENT RISER BALCONY

(71) Applicant: PETRÓLEO BRASILEIRO S.A.—PETROBRAS, Rio de Janeiro (BR)

(72) Inventors: Helvio Ferreira Da Silva, Campo dos Goytacazes (BR); Marcelo Curzio Salomao, Rio de Janeiro (BR); Osvaldo Roberto Do Vale, Rio de Janeiro (BR); João Pedro Navarini, Rio de Janeiro (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 18/029,498

(22) PCT Filed: Sep. 21, 2021

(86) PCT No.: PCT/BR2021/050401
§ 371 (c)(1),
(2) Date: Mar. 30, 2023

(87) PCT Pub. No.: WO2022/067410
PCT Pub. Date: Apr. 7, 2022

(65) Prior Publication Data

US 2023/0374870 A1 Nov. 23, 2023

(30) Foreign Application Priority Data

Oct. 2, 2020 (BR) ..... 10 2020 020314-2

(51) Int. Cl.
*E21B 17/01* (2006.01)
*B63B 21/00* (2006.01)
*E21B 19/00* (2006.01)

(52) U.S. Cl.
CPC ..... *E21B 19/004* (2013.01); *B63B 21/00* (2013.01)

(58) Field of Classification Search
None
See application file for complete search history.

(56) References Cited

U.S. PATENT DOCUMENTS 5,427,180 A * 6/1995 dePaiva Leite ..... E21B 19/006 405/224.2
6,375,391 B1 * 4/2002 Børseth ..... B63B 35/4413 405/224.4

(Continued)

FOREIGN PATENT DOCUMENTS

BR 9005039 A 3/1993
BR PI0408048 A 2/2006

(Continued)

OTHER PUBLICATIONS

Campagnac Wollner, Jan. 2016, Arranjos de convés de FPSO para operação no Pré-Sal (FPSO deck arrangements for Pre-Salt operation), Graduation Project, Polytechnic School of Federal Univ of Rio de Janeiro.

(Continued)

*Primary Examiner* — Matthew R Buck
*Assistant Examiner* — Douglas S Wood
(74) *Attorney, Agent, or Firm* — Knobbe Martens Olson & Bear, LLP

(57) ABSTRACT

The present invention addresses to the design of a Polyvalent Riser Balcony for an FPSO-type floating unit and the sequencing of the functions of the wells interconnected to the SPU in advance, even before the discovery of the field; consequently, without having the definition of the reservoir drainage plan and the subsea layout. The Polyvalent Riser Balcony can be applied to any development design for new offshore fields. The application of the invention will allow (Continued)

the anticipation of the FPSO production design, as well as its construction and assembly, with great value generation for the production development plans.

11 Claims, 7 Drawing Sheets

(56) References Cited

U.S. PATENT DOCUMENTS

| | | | | |
|---|---|---|---|---|
| 6,385,391 | B1 * | 5/2002 | Higuchi | G11B 5/48 |
| 6,884,003 | B2 * | 4/2005 | Horton, III | E21B 19/004 405/224.2 |
| 8,522,880 | B2 * | 9/2013 | Roodenburg | E21B 43/01 166/344 |
| 9,238,943 | B2 * | 1/2016 | Jordan | E21B 41/10 |
| 9,976,364 | B2 * | 5/2018 | Shilling, III | E21B 7/12 |
| 10,093,395 | B2 * | 10/2018 | Felderhoff | B63B 21/507 |
| 10,183,730 | B2 * | 1/2019 | Brinkel | B63B 83/10 |
| 11,274,504 | B2 * | 3/2022 | Amorim | E21B 19/006 |
| 2004/0182297 | A1 * | 9/2004 | Wybro | E21B 19/004 114/230.1 |
| 2004/0240947 | A1 * | 12/2004 | Wetch | E21B 19/004 405/224.2 |

FOREIGN PATENT DOCUMENTS

| | | | | |
|---|---|---|---|---|
| WO | WO 1997/007016 | | 2/1997 | |
| WO | WO 2014/170375 | | 10/2014 | |
| WO | WO-2014170375 | A1 * | 10/2014 | E21B 19/004 |
| WO | WO 2019/044194 | | 3/2019 | |
| WO | WO-2021160457 | A1 * | 8/2021 | B63B 21/50 |

OTHER PUBLICATIONS de Abreu Campos et al., Oct. 2017, Lula Alto—Strategy and Execution of a Megaproject in Deep Water Santos Basin Pre-Salt, OTC-28164-MS, 21 pp.

Gervasio de Araujo, Mar. 2015, Análise Estrutural de Suporte de Risers (Structural Analysis of Riser Support), Project of Graduation, Polytechnic School of Federal Univ of Rio de Janeiro.

Moreira Matoso Ribeiro Gomes et al., May 2017, Subsea Projects Cost Reduction—Petrobras Approach, Results and Next Steps, OTC-27833-MS, 13 pp.

* cited by examiner

Figure 5

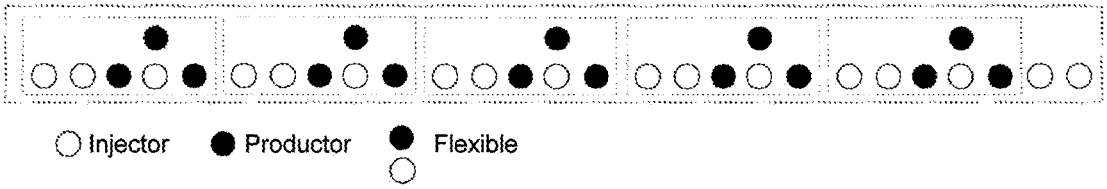

○ Injector ● Productor ● ○ Flexible

| | TYPE 1 | | | PREFERRED BALCONY ON THE PORT SIDE | | | | | | | | | | | | | | | | | | | | | | |
|---|---|---|---|---|---|---|---|---|---|---|---|---|---|---|---|---|---|---|---|---|---|---|---|---|---|---|
| SUPPORT | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 |
| KEY | WG | PRM | WG | PO | POT | PF | SV | WF | PO | WG | STU | WG | PO | SV | PF | MGL | WF | PO | STU | WG | SV | WG | PO | PF | POT | WF |
| FUNCTION | IG | UEH | IG | PO | UMB | PO | SV | SV | PO | IG | UEH | IG | PO | SV | PO | MSGL | SV | PO | UEH | IG | SV | IG | PO | PO | UMB | SV |
| FLEXIBILITY | IA | PRM | IA | | POT | IA | | IA | | IA | | IA | | | IA | | IA | | | IA | | IA | | IA | POT | IA |
| | | | | | | IG | | IG | | | | | | | IG | | IG | | | | | | | IG | | IG |

| SUPPORT | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 |
|---|---|---|---|---|---|---|---|---|---|---|---|---|---|---|---|---|---|---|---|---|---|---|---|---|---|---|
| KEY | PO | UEG | EG | STU | WGE | SV | WG | PO | MGL | PF | STU | WF | PO | STU | WG | POT | WG | PO | SV | PF | POT | WF | PO | WG | PRM | WG |
| FUNCTION | PO | UEH | EG | UEH | IG | SV | IG | PO | MSGL | PO | UEH | SV | PO | UEH | IG | UMB | IG | PO | SV | PO | UMB | SV | PO | IG | UEH | IG |
| FLEXIBILITY | | ESDV | SV | | IA | | IA | | | PO | | IG | | | IA | POT | IA | | | IA | POT | IG | | IA | PRM | IA |
| | | COT | MSGL | | EG | | | | | IA | | IA | | | | | | | | IG | | IA | | | | |

Figure 6

| SUPPORT | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 |
|---|---|---|---|---|---|---|---|---|---|---|---|---|---|---|---|---|---|---|---|---|---|---|---|---|---|---|
| KEY | WG | PRM | WG | PO | POT | PF | SV | WF | PO | WG | STU | WG | PO | SV | PF | MGL | WF | PO | STU | WG | SV | WG | PO | PF | POT | WF |
| FUNCTION | IG | UEH | IG | PO | UMB | PO | SV | SV | PO | IG | UEH | IG | PO | SV | PO | MSGL | SV | PO | UEH | IG | SV | IG | PO | PO | UMB | SV |
| FLEXIBILITY | IA | PRM | IA | | POT | IA | | IA | | IA | | IA | | | IA | | IA | | | IA | | IA | | IA | POT | IA |
| | | | | | | IG | | IG | | | | | | | IG | | IG | | | | | | | IG | | IG |

| SUPPORT | 27 | 28 | 29 | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 |
|---|---|---|---|---|---|---|---|---|---|---|---|---|---|---|---|---|---|---|---|---|---|---|---|---|---|---|
| KEY | PO | UEG | EG | STU | WGE | SV | WG | PO | MGL | PF | STU | WF | PO | STU | WG | POT | WG | PO | SV | PF | POT | WF | PO | WG | PRM | WG |
| FUNCTION | PO | UEH | EG | UEH | IG | SV | IG | PO | MSGL | PO | UEH | SV | PO | UEH | IG | UMB | IG | PO | SV | PO | UMB | SV | PO | IG | UEH | IG |
| FLEXIBILITY | | ESDV | SV | | IA | | IA | | | PO | | IG | | | IA | POT | IA | | | IA | POT | IG | | IA | PRM | IA |
| | | COT | MSGL | | EG | | | | | IA | | IA | | | | | | | | IG | | IA | | | | |

POLYVALENT RISER BALCONY

FIELD OF THE INVENTION

The object of this invention is the design of a riser balcony, a support structure located on the side of an FPSO, and the anticipated sequencing of the functions of the wells interconnected to the same, even before the field is discovered; consequently, without having the definition of the drainage plan for the reservoir and the subsea layout. The so-called polyvalent riser balcony can be applied in any development design for new offshore fields.

DESCRIPTION OF THE STATE OF THE ART

The design and construction of an oil production unit in an offshore area constitutes the main critical path for the start of production in a field. Therefore, reducing the design, construction and assembly time of an FPSO promotes a strong reduction in the time elapsed between the discovery of an oil field and the start of its production.

In FPSO-type units, the connection structure between the risers (suspended sections of the pipes that interconnect the subsea production lines to the floating units) and the ship depends on the mooring system. This structure can be presented in two basic configurations: riser balcony and turret.

In the spread mooring type anchoring system, the risers are normally installed on a platform on the side of the unit, close to the main deck, which is called the riser balcony, as reported in "*Análise Estrutural de Suporte de Risers*" ("Structural Analysis of Riser Support"), Project of Graduation, UFRJ/POLI/Naval and Ocean Engineering, 2015.

As described in "*Arranjos de convés de FPSO para operação no Pre-Sal*" ("FPSO deck arrangements for Pre-Salt operation"), UFRJ/ESCOLA POLITÉCNICA, 2016, the risers are coupled to the FPSOs by means of two riser balconies, called lower riser balcony and upper riser balcony. The risers are connected to the FPSOs hull through the lower riser balcony, passing through the multifunctional bell mouths, which are responsible for locking and directing the risers. The upper riser balcony supports the ends of the risers and connects them to the process plant. The risers are locked to the upper riser balcony via hang-offs and routed to the production manifold. The risers are connected between the two balconies by means of I-tubes.

Still according to "*Arranjos de convés de FPSO para operação no Pre-Sal*" ("FPSO deck arrangements for Pre-Salt operation"), UFRJ/ESCOLA POLITÉCNICA, 2016, the positioning of the risers along the riser balconies is defined by the subsea arrangement of the unit.

Each well connected to the FPSO has a specific function in the deposit drainage network, seeking to optimize oil extraction. Entry sequencing and connection of wells on the riser balcony affect the entire design of production and injection lines and their interconnections with the process plant. Consequently, the definition of the production system design can only be concluded after defining the subsea layout and the respective sequencing of functions of the riser balcony.

Normally, the traditional design of the riser balcony follows the sequence: (1) discovery and delimitation of the field, (2) design of the drainage network of the deposit, (3) drafting of the subsea layout design, (4) definition of the sequence of functions of the wells in the riser balcony.

Following the traditional approach, after the discovery and delimitation of the field, its drainage network can be defined, which translates into the number and location of the wells and their functions (producer, water injector, gas injector) in the recovery of oil from the field. Once the well positions are defined, the subsea system is designed, with the interconnection of the wells to the FPSO production system (subsea layout), which takes place on its side, more specifically on the riser balcony. Upon following this traditional flow of activities, the sequencing of connections can only be defined after the definition of the deposit drainage network and the respective subsea layout, which means several months or years after the discovery.

The object of this invention is the design of a polyvalent riser balcony, which allows sequencing the functions of the wells (injector, producer, WAG) in advance, even before the discovery of the field; consequently, without having the definition of the drainage plan for the reservoir and the subsea layout.

The standardized riser balcony makes the design of the FPSO production system independent of the design of the well network and the subsea design. Thus, the drafting of the FPSO design, as well as its construction and assembly can be significantly anticipated, with great value generation for field production development designs, in addition to promoting a very high financial gain for the design.

In the embodiment of this invention, the upper riser balcony consists of up to 5 cells (a standard unit that is repeated along the length of the balcony), each cell containing a fixed combination of wells, the set of cells occupying up to 52 slots. Depending on the scope of a design or group of designs, the polyvalent balcony can be designed and pre-defined with a smaller number of cells and slots.

The paper "Lula Alto—Strategy and Execution of a Megaproject in Deep Water Santos Basin Pre-Salt", OTC-28164-MS, October 2017 presents the Lula Alto Project. The work describes, among others, the conceptual model of the reservoir, the optimization of the drainage plan, the optimization of the subsea layout that led to a minimum length of flow line per well, the design development and rapid ramp-up.

The main scope of the Lula Alto project is a subsea connection to a chartered FPSO, consisting of 11 producing wells (satellites) and 6 injectors, 4 of which are satellites and 2 connected by an injection manifold, prepared to operate as WAG (Water Alternating Gas—alternating injection of water and gas). The wells are connected through flexible flow lines to flexible risers, supported using a lazy-wave configuration. During the conceptual phase of the Lula Alto Project, alternatives for coupled (SLWR—Steel Lazy Wave Risers) and uncoupled (BSR—Buoyancy Supported Risers and MHR—Multi Hybrid Risers) systems were studied. The chosen alternative was based on a system of coupled flexible risers, which features a lazy-wave configuration for production, service, water injection and gas injection risers, and a free suspension catenary configuration for electro-hydraulic umbilicals (EHU).

Still in "Lula Alto—Strategy and Execution of a Megaproject in Deep Water Santos Basin Pre-Salt", OTC-28164-MS, October 2017, the subsea layout was designed to deploy the FPSO in a central position, minimizing the distance between FPSO and wellheads in order to optimize flow line lengths, installation costs, and production flow. According to the work, the layout in question is effective in terms of cost and production, but brings some challenges in relation to well connection operations, as the riser balcony is positioned on the port side and some wellheads are located on the starboard side. As a result, some risers must be installed in a keel configuration, which requires customized operating procedures to reduce the risk of objects falling onto the risers. Particularly, the riser balcony of the FPSO Cidade de Maricá has 55 slots and the connection of additional wells is feasible. The design flexibility is reinforced by the selection of flexible flow lines, which allows future conversions of producing wells into injecting ones, according to the best production strategy. The Lula Alto project involved the need of acquiring the FPSOs and some LLIs (Long Lead Items) in advance, which required the definition in the initial stage of the scope and characteristics of the design with only the initial results of the reservoir.

Unlike the present invention, the work described in "Lula Alto—Strategy and Execution of a Megaproject in Deep Water Santos Basin Pre-Salt", OTC-28164-MS, October 2017 uses a chartered unit and, consequently, the riser balcony already existing in the FPSO. In this invention, there is the design of a pre-specified balcony, the Polyvalent Riser Balcony, to be incorporated in FPSOs construction and assembly designs. The slot configuration of the work in question is based on the use of flexible risers, whereas, in the present invention, the slot configuration has flexibility for rigid and flexible risers. Further, the work provides in advance the definition of the drainage plan for the reservoir and the subsea layout, unlike the present invention.

In "Subsea Projects Cost Reduction—Petrobras Approach, Results and Next Steps", OTC-27833-MS, 2017, the possibility of using the riser balcony positioned on the starboard side of its FPSO was studied, with the balconies on the port side being the standard, given the availability for the approach of the supply vessel. The work evaluated the risks and benefits in relation to mooring operations, inspection/maintenance, and supply operations on the starboard side, considering the presence of risers. The conclusion of the study showed that the position of the balcony on the starboard side was feasible, considering the characteristics of the operational procedures and the environmental conditions, and could bring flexibility when the wells are placed on the starboard side of the FPSO, avoiding drag and resulting in reductions in the length of flow lines. It was also identified that a possible benefit could be obtained with the reduction of movement in the riser balcony, resulting in gains for the riser system design. The work does not address to the design of a pre-specified balcony that allows the definition of the FPSO production system independently of the definition of the well network and the subsea design, such as the present invention.

In WO1997007016A1, the invention refers to a method and a device for use in loading oil from a subsea oil deposit into an FPSO, in which one or more risers are employed. The objective of the invention is to simplify the type of oil loading, especially from a subsea oil deposit, avoiding the need for expensive and complicated turret designs on special ships. The method and the device of the invention are especially suitable for use in connection with ships that employ dynamic positioning, eliminating the need for any type of anchoring, which results in additional cost savings.

As described in WO1997007016A1, the riser balcony is placed near the outside of the ship hull, in the midship area, where the ship movements due to waves are as small as possible. The surface level of the riser balcony is at the ship main deck level and is an area for system operation and maintenance. On the balcony, there are quick coupling/disconnecting elements (QC/DC) at the deck level of the balcony. The upper parts of these elements are fixed to the top of the balcony, permanently connected to ducts that lead to the vessel processing area. The coupling elements are designed to receive up to four flow lines per element. The elements are mechanically connected for simultaneous release, or they can be released separately.

Further according to WO1997007016A1, a floating element is placed under the riser balcony. All risers and umbilicals pass through the seaside floating element to the lower part of the coupling elements. On top of the floating element, guide pins are provided for coupling purposes. The upper part of the guide pins is designed for connection with the wires from the balcony winches. In the embodiment of the invention, the floating element will have a free edge that abuts the lower part of the balcony. The lower part of the floating element will have sufficient buoyancy to maintain the buoyancy of the element positioned under the balcony. When the floating element is connected to the ship, or to the balcony, it is attached to the conductor casing of the balcony at the upper part, and the lower part of the floating element is connected to the ship by means of simple locking devices that are located at the front and rear ends of the floating element. In order to protect the floating element and the ship side, a protection device is provided between the ship side and the floating element. At the bottom of the floating element, the riser entry is protected with bending limiters. One of the essential features of the invention is that the connection to the risers can be released very quickly by means of the coupling elements, if a critical situation arises, avoiding breakage of the risers, pollution or substantial mechanical destruction.

The method and device disclosed in WO1997007016A1 are applicable for use in connection with ships that employ dynamic positioning, unlike the present invention. Another difference with respect to this invention is that, in said work, a floating element is placed under the riser balcony, through which the risers and umbilicals pass. The present invention describes an upper riser balcony, consisting of a set of cells, each cell containing a fixed combination of wells, and a lower riser balcony, where three distinct configurations are possible.

In WO2014/170375A1, the invention relates to the design of a riser balcony for a floating unit, which comprises a support portion adapted to support at least one riser. The riser balcony further comprises a connection part adapted to connect the support part to the floating unit. The support portion may comprise one or more members that are separate from the one or more members that form the connecting portion. Optionally, the support portion and the connection portion can form a unitary component. The riser balcony extends in a longitudinal direction and in a transverse direction. Optionally, the riser balcony further extends in a vertical direction, with each of the connecting plates further extending substantially in a vertical direction.

In the embodiment of the invention disclosed in WO2014/170375A1, three risers are illustrated, each of which is connected to the floating unit through a riser balcony. In FIG. 1 of the work, the riser balcony is adapted to be located below the surface of standing water. However, the work discloses that other riser balcony modalities can be adapted to be located on or above the surface of standing water. Furthermore, FIG. 1 of the work illustrates that each of the risers may comprise a corresponding upper part, which extends from the riser balcony to another part of the floating unit. The upper portion may form a unitary component with the corresponding portion of the riser extending downwardly from the riser balcony. The riser balcony comprises a support portion adapted to support at least one riser. As a non-limiting example of the invention, a support portion can be adapted to support at least three risers, or even eight risers. In the present invention, in turn, the upper riser balcony consists of a set of up to 5 cells, which is repeated along the length of the balcony, each cell containing a fixed combination of wells, the set of cells occupying up to 52 slots, with flexibility for rigid and flexible risers. The lower riser balcony can have three different configurations, namely preferred balcony on the port side, preferred balcony on the starboard side and central SPU balcony (port side/starboard side).

BRIEF DESCRIPTION OF THE INVENTION

The present invention addresses to the design of a riser balcony for a floating unit of the FPSO type and the sequencing of the functions of the wells interconnected to the FPSO in advance, even before the discovery of the field; that is, without having the definition of the reservoir drainage plan and the subsea layout. The application of the invention will allow the anticipation of the FPSO design, as well as its construction and assembly, with great value generation for the plans to develop the production of a field.

BRIEF DESCRIPTION OF THE DRAWINGS

The present invention will be described in greater detail below, with reference to the attached figures which, in a schematic and non-limiting way of the inventive scope, represent examples of its embodiment. The figures are:

FIG. 5, which illustrates the Polyvalent Riser Balcony, object of this invention. Its configuration has a fixed sequencing, but with the necessary flexibility for the drainage network. Particularly, the black and white circles represent the interconnections of producing and injecting wells, respectively, also considering 5 flexible interconnections (supports with a dual function that allow both the interconnection of a producing well and an injection well). FIG. 5 also shows a cluster of 5 wells, then called cells, consisting of 2 producing wells+2 injection wells+1 flexible well (producer/injector). In total, the Polyvalent Riser Balcony can accommodate up to 5 cells and 2 extra injection wells. FIG. 5 also identifies the types of risers used in sequencing the polyvalent balcony, which will allow interconnecting both the production and injection risers, as well as other functions necessary for the design: service lines, gas lift manifolds, gas exporting/importing, control umbilicals, power (actuation of pumping or processing systems), ESDV and PRM (Permanent Reservoir Monitoring) control umbilicals. There are represented: PO (PO)-production riser, WG (IG/IA)-gas/water injection riser, PF (PO/IG/IA)-gas/water production/injection riser, WF (SV/IG/IA)-gas lift/gas/water injection riser, SV (SV)-service/gas lift riser, MGL (MSGL)-gas lift manifold riser, STU (UEH) electro-hydraulic control umbilical, POT (UMB POT)-power umbilical, EG (EG/SV/MSGL)-gas exporting/importing/service/gas lift manifold riser, UEG (UEH ESDV/COT)-ESDV umbilical and optical cable, PRM (UEH PRM)-control umbilical/RPM.

FIG. 6, which illustrates the Polyvalent Riser Balcony, object of this invention, with the upper riser balcony consisting of up to 5 cells (standard unit that is repeated along the length of the balcony), plus 2 extra injection wells, each cell containing a fixed combination of wells, the set of cells, including the 2 extra injection wells, occupying up to 52 slots, with flexibility for rigid and flexible risers. FIG. 6 also shows a predefined sequencing with 10 producing wells+6 WAG Loop (12 injection wells)+5 Flexible (which can be a producing well convertible into an injection well, or a pair of injection wells in a WAG Loop). FIG. 6 further identifies the types of risers used in sequencing the polyvalent balcony, which will allow interconnecting both the production and injection risers, as well as other functions necessary for the design: service lines, gas lift manifolds, gas exporting/importing, control umbilicals, power (actuation of pumping or processing systems), ESDV and PRM (Permanent Reservoir Monitoring) control umbilicals. The following are represented: PO (PO)-production riser, WG (IG/IA)-gas/water injection riser, PF (PO/IG/IA)-gas/water production/injection riser, WF (SV/IG/IA)-gas lift/gas/water injection riser, SV (SV)-service/gas lift riser, MGL (MSGL)-gas lift manifold riser, STU (UEH) electro-hydraulic control umbilical, POT (UMB POT)-power umbilical, EG (EG/SV/MSGL)-gas exporting/importing/service/gas lift manifold riser, UEG (UEH ESDV/COT)-ESDV umbilical and optical cable, PRM (UEH PRM)-control umbilical/RPM.

DETAILED DESCRIPTION OF THE INVENTION

Figure 1:
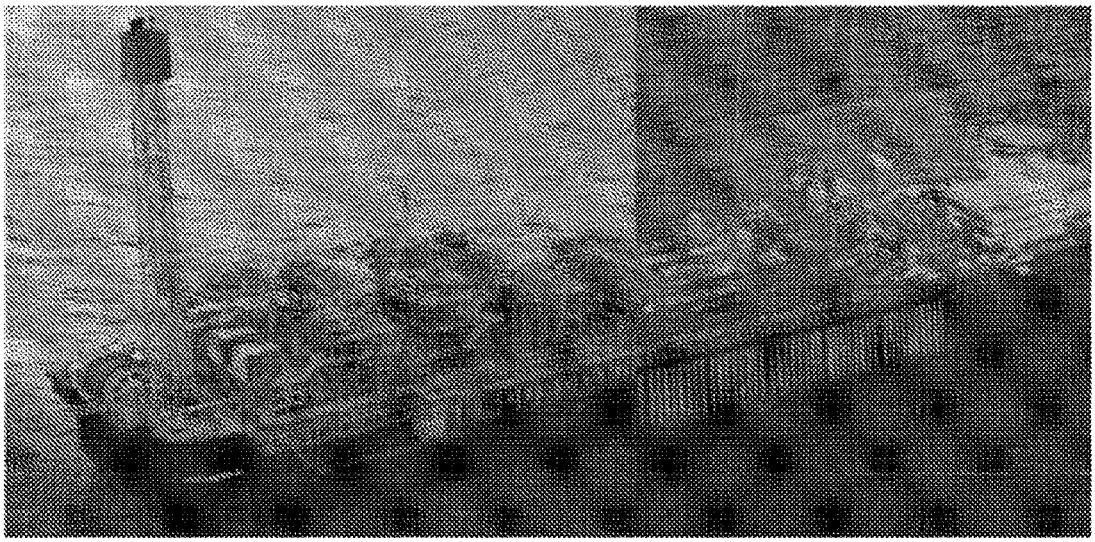
FIG. 1, which illustrates a FPSO floating unit, with emphasis on the riser balcony.
Figure 2:
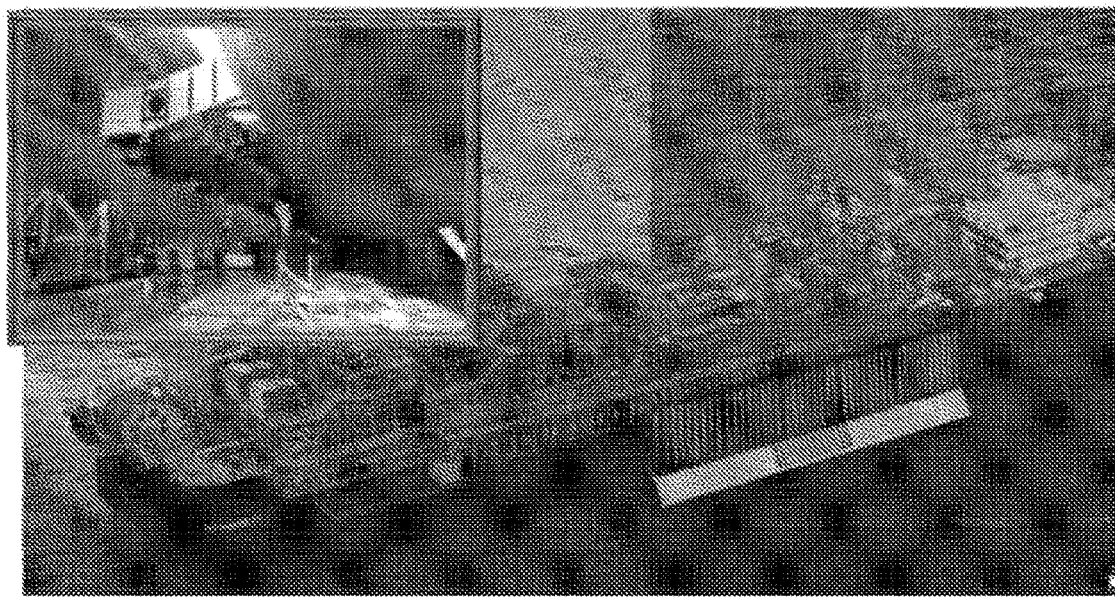
FIG. 2, which illustrates an FPSO-type floating unit, with emphasis on the riser balcony and the arrival of the risers.

The present invention addresses to the design of a riser balcony for a floating production unit of the FPSO type and the sequencing in advance of the functions of the wells to be connected, without having the definition of the reservoir drainage plan and the subsea layout. The riser balcony of an FPSO is a support structure, located on the side of the ship, where the lines connecting the wells to the production system located on the deck arrive, as illustrated in FIGS. 1 and 2. The entry sequencing and connection of wells in the riser balcony affects the entire design of production and injection lines in the process plant.

The Polyvalent Riser Balcony, object of this invention, has as its main attribute to be specified in advance and independently of the subsea layout definition, with sufficient flexibility to efficiently meet numerous well location plans and subsea designs. As a result, it is possible to pre-specify and design the production system even before the deposit is discovered. The possibility of starting the design, construction and assembly of the FPSO independently from the definition of the drainage network and the subsea layout reduces by several months, or even years, the critical path for the start of production in a field, consistently increasing the financial return on production development designs. The polyvalent riser balcony can be applied in any development design of new offshore fields.

This new approach constitutes a paradigm shift, allowing the design of the arrival arrangement of the risers and their interconnection with the process plant free of the subsea layout design.

Figure 3:
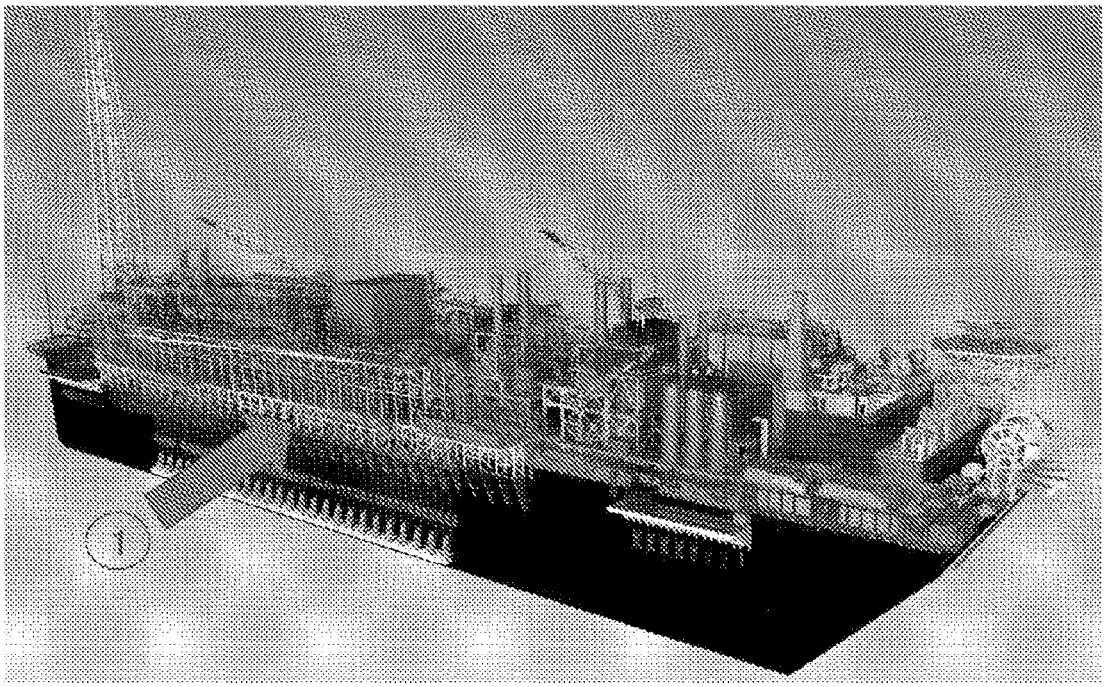
FIG. 3, which illustrates a FPSO-type floating unit, highlighting the upper riser balcony (1).
Figure 4:
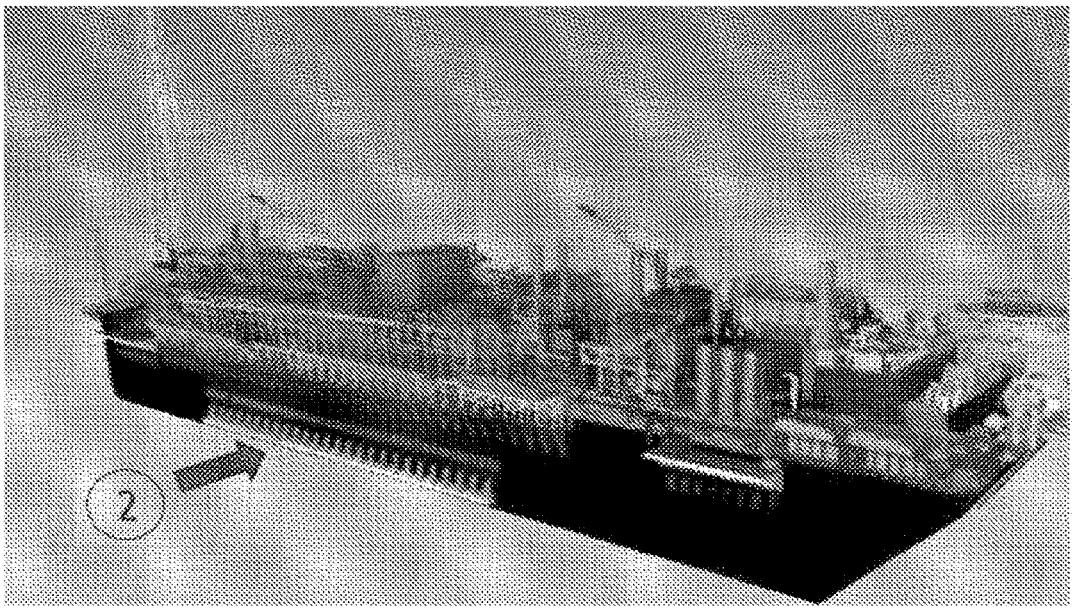
FIG. 4, which illustrates a FPSO-type floating unit, highlighting the lower riser balcony (2).

The sequencing of functions of the wells in the upper riser balcony affects and defines the entire surface plant design. The lower riser balcony in turn is only responsible for receiving the flow lines and leading them to the upper balcony and fundamentally depends on the direction of arrival of the wells. Therefore, it has a varied design, depending on the relative position between the FPSO and the field. The upper and lower riser balconies are indicated in FIGS. 3 and 4, respectively.

Figure 7:
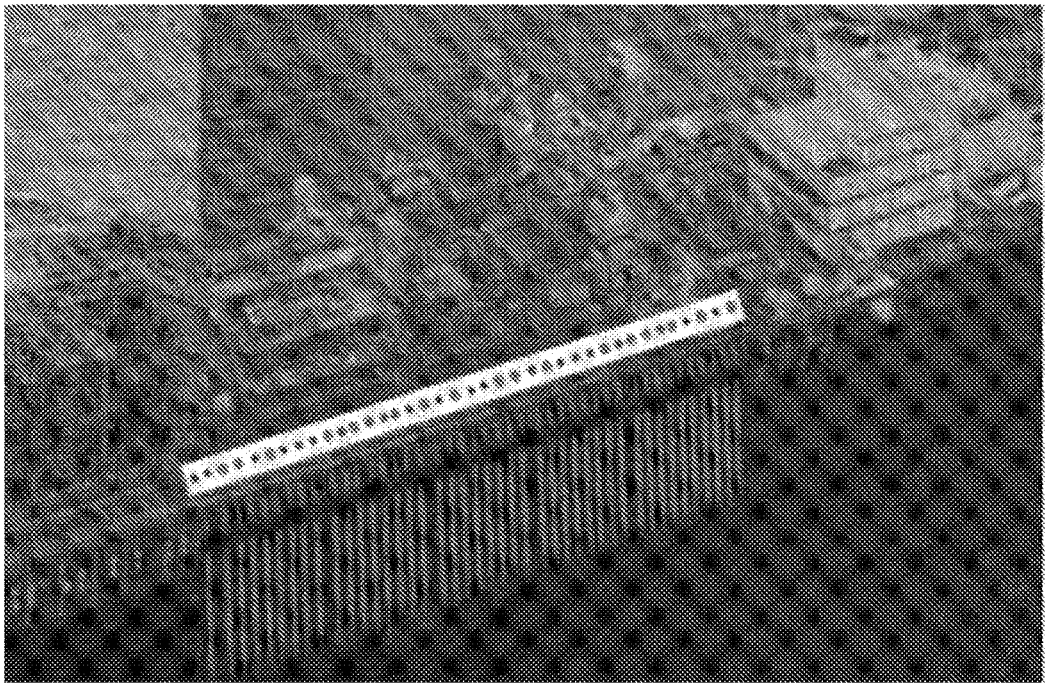
FIG. 7, which illustrates a FPSO-type floating unit, with emphasis on the configuration of well functions on the upper riser balcony of the Polyvalent Riser Balcony. Particularly, the green and red symbols represent the interconnections of producing and injecting wells, respectively.
Figure 8:
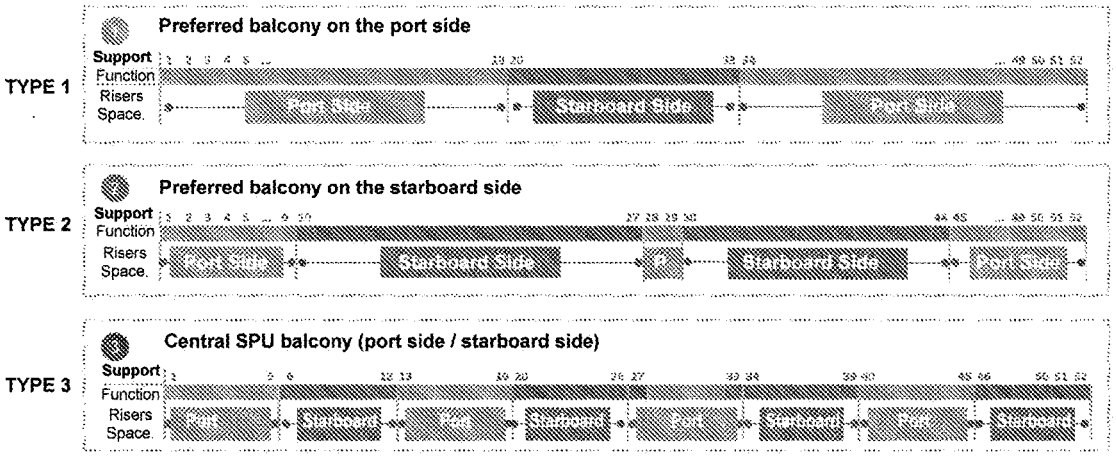
FIG. 8, which illustrates three alternative configurations for the lower riser balcony, in relation to the preferred arrival side, namely: Type 1—preferred balcony on the port side, in which the largest number of interconnected risers is defined on the port side from azimuths (direction of arrival) of the risers previously defined on the lower balcony, Type 2—preferred balcony on the starboard side, in which the largest number of risers interconnected on the starboard side is defined from azimuths of the risers previously defined on the lower balcony, and Type 3—central SPU balcony (port side/starboard side), in which a balanced distribution of the number of risers for both sides (port side and starboard side) is defined, based on the azimuths of the risers previously defined in the lower balcony.
Figure 9:
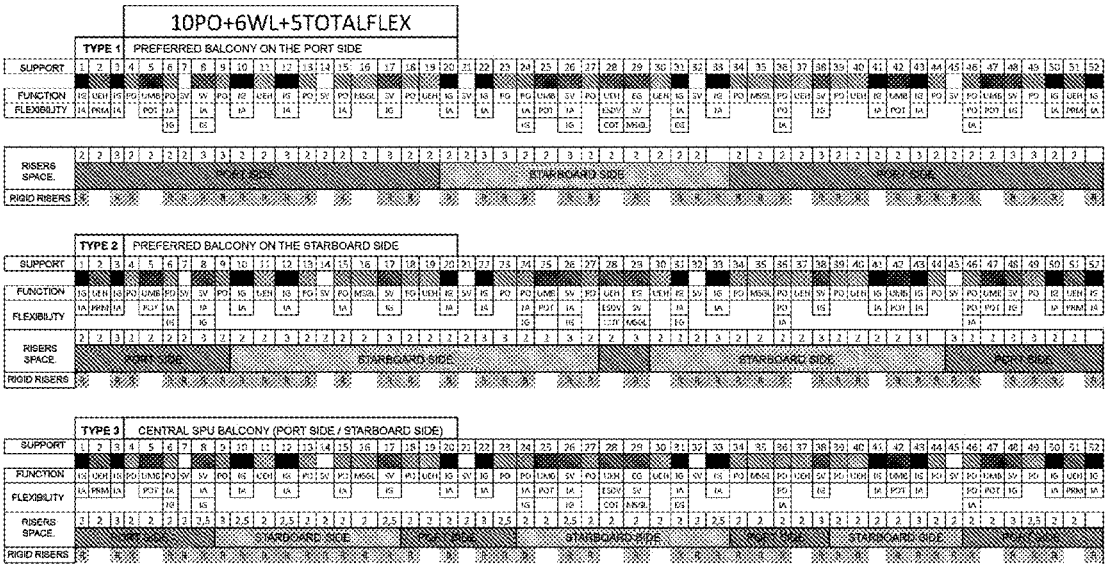
FIG. 9, which illustrates the Polyvalent Riser Balcony with alternative lower riser balcony configurations.
Figure 10:
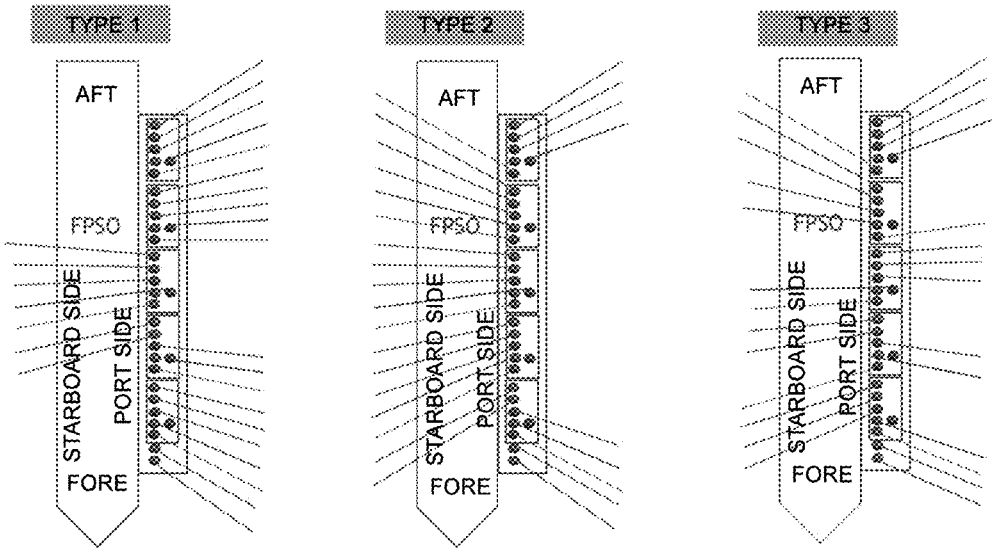
FIG. 10, which illustrates the Polyvalent Riser Balcony with alternative configurations for the lower riser balcony, including the lower balcony entry edge flexibilities.
Figure 11:
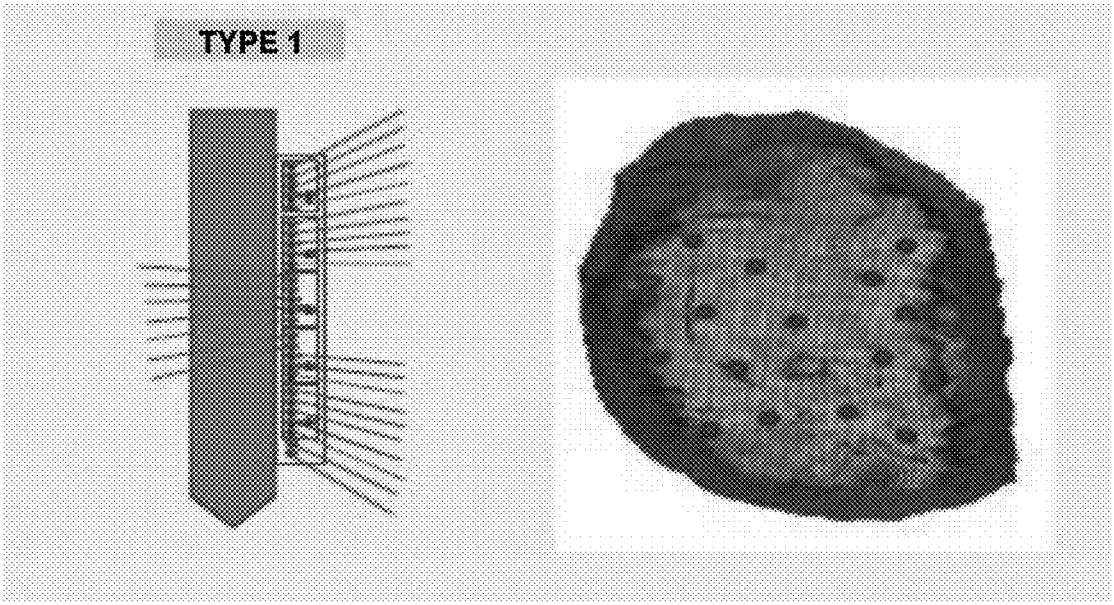
FIG. 11, which illustrates the Polyvalent Riser Balcony with the alternative Type 1 configuration for the lower riser balcony, including the lower balcony entry edge flexibilities.
Figure 12:
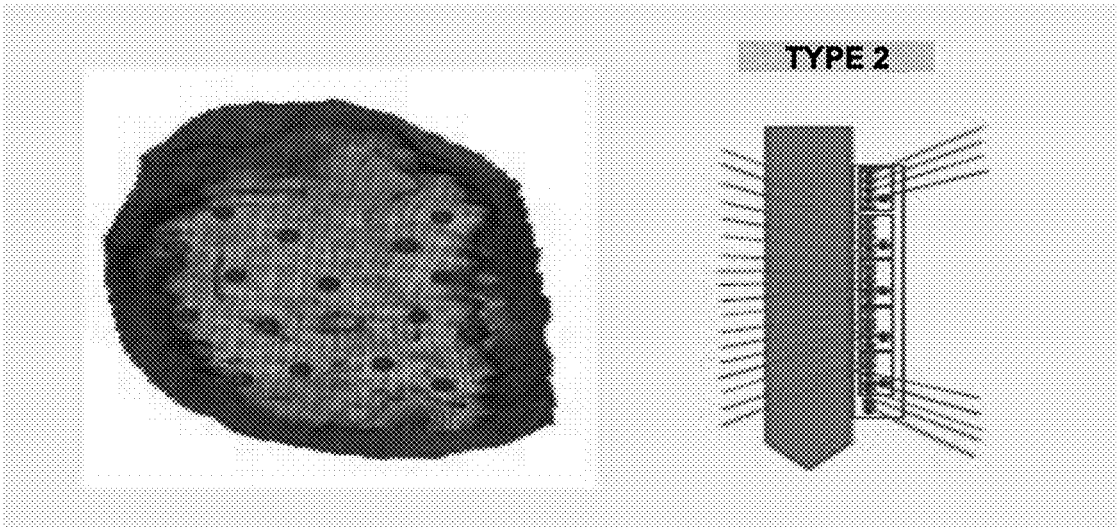
FIG. 12, which illustrates the Polyvalent Riser Balcony with the alternative Type 2 configuration for the lower riser balcony, including the lower balcony entry edge flexibilities.
Figure 13:
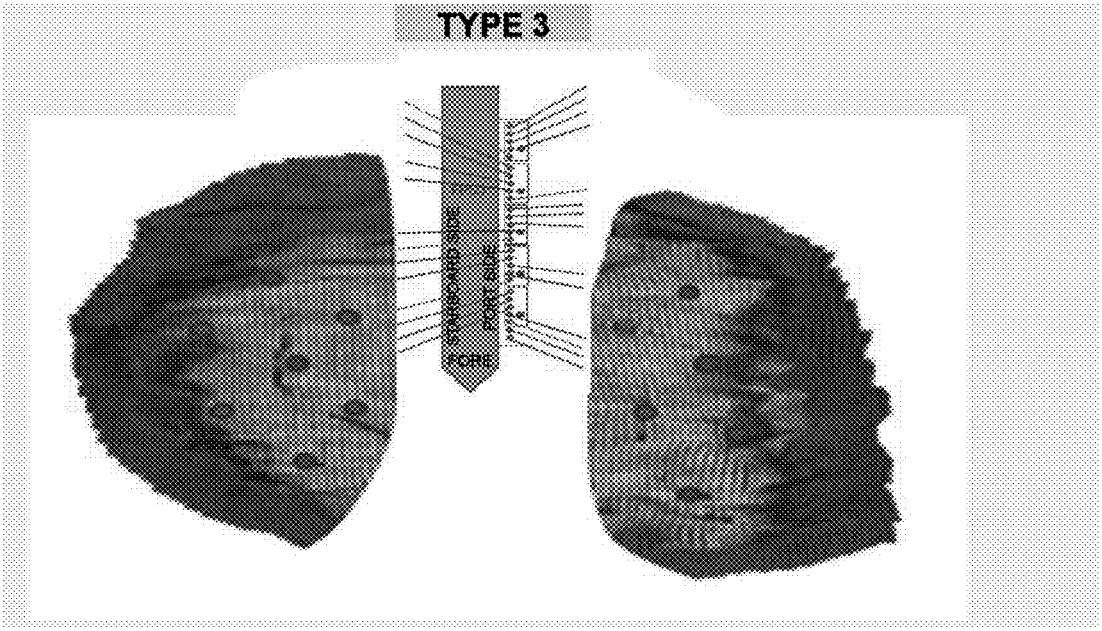
FIG. 13, which illustrates the Polyvalent Riser Balcony with the alternative Type 3 configuration for the lower riser balcony, including the lower balcony entry edge flexibilities.

In this invention, the upper riser balcony consists of up to 5 cells (a standard unit that is repeated along the length of the balcony), each cell containing a fixed combination of wells. In addition to the set of cells, there are 2 extra injection wells, occupying up to 52 slots in total, with flexibility for rigid and flexible risers, as can be seen in FIGS. 5 to 7. Analyzes carried out (back tests) indicate that the configuration can flexibly meet a wide range of drainage plans.

Depending on the scope of a design or group of designs, the polyvalent balcony can be designed and predefined with a smaller number of cells and slots.

In the present invention, three alternative configurations were created for the lower riser balcony, namely: Type 1—preferred balcony on the port side, in which the largest number of risers are defined to be interconnected on the port side from azimuths (direction of arrival) of previously defined risers on the lower balcony, Type 2—preferred balcony on the starboard side, in which the largest number of risers are defined to be interconnected on the starboard side from the azimuths of the risers previously defined on the lower balcony, and Type 3—central SPU balcony (port side/starboard side), in which a balanced distribution of the number of risers is defined for the two sides (port side and starboard side) from the azimuths of the risers previously defined on the lower balcony, as can be seen in FIGS. 8 to 13.

The validation of this invention was done through retrospective tests (back tests) carried out in fields currently in production.

In the proposed sequencing for the polyvalent balcony, the use of subsea processing and boosting systems is also allowed, limited to the use of up to 4 electric power umbilicals, in addition to having 2 service lines that may be required by these types of subsea systems.

The invention claimed is:

1. A polyvalent riser balcony of a floating production storage and offloading (FPSO) unit comprising:
- a lower balcony extending along a length of a side of the FPSO, wherein the lower balcony comprises:
  - a first plurality of cells, each of the first plurality of cells comprising:
    - two injector slots;
    - two producer slots; and
    - a flexible slot configurable to be an injector slot or a producer slot; and
    - two exterior injector slots positioned adjacent the plurality of cells,
    - wherein each of the two injector slots, the two producer slots, and the flexible slot are connected to a riser of a plurality of risers, wherein each of the plurality of risers extends to the seafloor and is coupled to a well, and wherein at least one of the plurality of risers extends in a first direction under the FPSO and at least one of the plurality of risers extends in a second direction other than the first direction and away from the FPSO.

2. The polyvalent riser balcony of claim 1, wherein the first plurality of cells comprises a first cell positioned adjacent a second cell, a third cell positioned adjacent the second cell, a fourth cell positioned adjacent the third cell, and a fifth cell positioned adjacent the fourth cell, and wherein the two exterior injector slots are positioned adjacent the fifth cell.

3. The polyvalent riser balcony of claim 2, wherein each of the risers of cell three and the risers of the injector slots of cell four, extend in the first direction while the remaining risers extend in the second direction.

4. The balcony of claim 2, wherein the risers of the second cell, third cell, fourth cell, the injector slots of the fifth cell, and a producer slot of the first cell, extend in the first direction while the remaining risers extend in the second direction.

5. The balcony of claim 2, wherein the following risers extend in the first direction:
- a productor slot of the first cell;
- both injector slots, a productor slot, and a flexible slot of the second cell;
- the flexible slot and a producer slot of the third cell;
- both injection slots and a production slot of the fourth cell; and
- both injection slots and a production slot of the fifth cell,
- wherein the remaining risers extend in the second direction.

6. The balcony of claim 2, wherein each of the plurality of risers is a rigid riser.

7. The balcony of claim 2, wherein of the plurality of risers is a flexible riser.

8. The polyvalent riser balcony of claim 1, further comprising:
- an upper balcony positioned above the lower balcony, the upper balcony comprising a second plurality of cells, each of the second plurality of cells comprising:
  - two injector slots;
  - two producer slots; and
  - a flexible slot configurable to be an injector slot or a producer slot; and
- wherein the injector slots, producer slots, and flexible slot of the first plurality of cells in the lower balcony are arranged in the same position as the injector slots, producer slots, and flexible slots as the second plurality of cells in the upper balcony, and wherein the injector, producer and flexible slots of the first plurality of cells and the second plurality of cells are connected via risers, and wherein the risers extend from the lower balcony toward the seafloor.

9. The polyvalent riser balcony of claim 1, wherein the first direction is a starboard direction and the second direction is a port direction.

10. The polyvalent riser balcony of claim 1, further comprising a second lower balcony with a second plurality of cells extending along another side of the FPSO.

11. The polyvalent riser balcony of claim 1, wherein a configuration of the two injector slots, the two producer slots, and the flexible slot in each of the plurality of cells, including the direction of the risers is determined prior to connecting the two injector slots, the two producer slots, and the flexible slot to the plurality of risers based on a determined a subsea well layout.

* * * * *